US009599320B2

(12) United States Patent
Sohn et al.

(10) Patent No.: US 9,599,320 B2
(45) Date of Patent: Mar. 21, 2017

(54) LED LIGHTING APPARATUS

(71) Applicant: SAMJIN LND CO., LTD., Hwaseong-si (KR)

(72) Inventors: Choong-Yong Sohn, Cheongju-si (KR); Geun Kyo Park, Iksan-si (KR); Jong Ho Kim, Osan-si (KR)

(73) Assignee: SAMJIN LND CO., LTD., Hwaseongsi (KR)

( * ) Notice: Subject to any disclaimer, the term of this patent is extended or adjusted under 35 U.S.C. 154(b) by 118 days.

(21) Appl. No.: 14/452,636

(22) Filed: Aug. 6, 2014

(65) Prior Publication Data

US 2015/0345754 A1 Dec. 3, 2015

(30) Foreign Application Priority Data

Jun. 2, 2014 (KR) ..... 10-2014-0067248

(51) Int. Cl.

| | |
|---|---|
| ***F21S 4/00*** | (2016.01) |
| ***F21V 17/10*** | (2006.01) |
| ***F21V 17/12*** | (2006.01) |
| ***F21V 23/00*** | (2015.01) |
| ***F21V 3/02*** | (2006.01) |
| ***F21V 31/00*** | (2006.01) |

(Continued)

(52) U.S. Cl.

CPC ..... *F21V 17/12* (2013.01); *F21S 4/008* (2013.01); *F21S 4/28* (2016.01); *F21V 17/104* (2013.01);

(Continued)

(58) Field of Classification Search

CPC ..... F21V 31/005; F21V 23/009; F21V 7/005; F21V 3/02; F21V 17/12; F21V 17/104; F21S 4/008; F21S 4/28

(Continued)

(56) References Cited

U.S. PATENT DOCUMENTS 6,652,117 B2 * 11/2003 Tsai ..... F21S 2/00 362/217.12
7,267,461 B2 * 9/2007 Kan ..... F21V 5/002 362/147

(Continued)

FOREIGN PATENT DOCUMENTS

JP 58-010309 1/1983
JP 2012-185962 9/2012

(Continued)

*Primary Examiner* — Elmito Breval
*Assistant Examiner* — Arman B Fallahkhair
(74) *Attorney, Agent, or Firm* — Lex IP Meister, PLLC

(57) ABSTRACT

An LED lighting apparatus is disclosed. The lighting apparatus according to an exemplary embodiment of the present invention includes: a main cover with an elongated pipe shape having a cross-section formed of a closed curve line and both ends of a length direction formed to be open; an external frame sliding-coupled to an external surface of the main cover along a length direction of the main cover; an inner frame having a shape extending in a direction parallel to the length direction of the main cover and sliding-coupled to an internal surface of the main cover along with the length direction of the main cover to be positioned at the inner space of the main cover; and a close-and-seal cover closing and sealing both open ends of the main cover to close and seal the inner space of the main cover, wherein the bottom surface of the inner frame supports an emitted LED, and the close-and-seal cover is coupled to the external frame and the inner frame.

16 Claims, 7 Drawing Sheets

(51) Int. Cl.
*F21V 7/00* (2006.01)
*F21V 15/01* (2006.01)
*F21Y 101/00* (2016.01)

(52) U.S. Cl.
CPC ..... *F21V 23/009* (2013.01); *F21V 31/005* (2013.01); *F21V 3/02* (2013.01); *F21V 7/005* (2013.01); *F21V 15/013* (2013.01); *F21Y 2101/00* (2013.01); *F21Y 2103/10* (2016.08); *F21Y 2115/10* (2016.08)

(58) Field of Classification Search
USPC ..... 362/218, 222, 223, 225, 240, 267, 368, 362/375, 217.12, 217.1, 235
See application file for complete search history.

(56) References Cited

U.S. PATENT DOCUMENTS 7,824,056 B2 * 11/2010 Madireddi ..... A47F 3/001 362/125
8,408,734 B2 * 4/2013 Wu ..... F21K 9/17 362/218
8,585,245 B2 * 11/2013 Black ..... F21V 31/00 362/217.1
8,616,730 B2 * 12/2013 Edwards, Jr. ..... H05B 33/0803 362/225
9,228,708 B2 * 1/2016 Dings ..... F21S 2/005 362/225
2007/0047229 A1 * 3/2007 Lee ..... F21S 4/008 362/237
2012/0033420 A1 * 2/2012 Kim ..... F21K 9/17 362/235
2013/0170209 A1 * 7/2013 Lee ..... F21V 31/005 362/249.01

FOREIGN PATENT DOCUMENTS

| | | |
|---|---|---|
| JP | 3180028 | 11/2012 |
| JP | 2013-243149 | 12/2013 |
| JP | 2014-006995 | 1/2014 |
| KR | 20-0422872 | 8/2006 |
| KR | 10-2010-0112104 | 10/2010 |
| KR | 10-1009468 | 1/2011 |
| KR | 1020110071864 | 6/2011 |
| KR | 101068906 | 9/2011 |
| KR | 101270585 | 6/2013 |

* cited by examiner

LED LIGHTING APPARATUS

CROSS-REFERENCE TO RELATED APPLICATION

This application claims priority to and the benefit of Korean Patent Application No. 10-2014-0067248 filed in the Korean Intellectual Property Office on Jun. 2, 2014, the entire contents of which are incorporated herein by reference.

BACKGROUND OF THE INVENTION (a) Field of the Invention

The present invention relates to an LED lighting apparatus. More particularly, the present invention relates to an LED lighting apparatus of a closed type.

(b) Description of the Related Art

Since a light emitting diode (LED) as a light semiconductor using a compound semiconductor was invented, a white LED has been rapidly developed in an aspect of efficiency of the emitted light compared with input power.

Thanks to the development of this light-efficient white LED, a characteristic that much light is emitted through low energy consumption is ensured, and currently, the white LED is replacing traditional light sources such as incandescent, fluorescent, and high-pressure discharge lamp light sources and is becoming widely used for lighting.

Of these, fluorescent lamps having particularly high luminous efficacy have been used as the most efficient lighting, until recently, but the efficiency of the LED lighting has overtaken that of the fluorescent lamps such that the fluorescent lamps are starting to be replaced by the LED lighting.

On the other hand, the LED lighting apparatus is penetrated by foreign matter such as dust and insects through a gap when using the device for a long period of time, and the foreign matter builds up inside the device such that the emission of light is shielded, thereby causing a reduction in illumination, and an electrical circuit failure may be generated by the foreign matter penetrated therein.

Also, in a case of outdoor use, a waterproofing function of the device is required, and for the sealing structure for the waterproofing, an expensive apparatus structure must be configured, such that the structure is complex and costly.

As a result, an LED lighting apparatus having an effective closed structure for waterproofing, dust-proofing, and blocking insects needs to be developed.

On the other hand, the LED lighting apparatus must have a wide light distribution angle in a case of a low ceiling and must have a narrow light distribution angle to transmit the light a long distance in a case of a high ceiling, such that it is necessary to differentiate the light distribution angle depending on the installation location, and for this, a complicated mechanism for the reflection or the refraction of light must be added inside the apparatus.

Without the complex addition mechanism, an LED lighting apparatus having an economical and simple internal structure to more effectively cope with the change of the light distribution angle needs to be developed.

The above information disclosed in this Background section is only for enhancement of understanding of the background of the invention, and therefore it may contain information that does not form the prior art that is already known in this country to a person of ordinary skill in the art.

SUMMARY OF THE INVENTION

An exemplary embodiment of the present invention provides an LED lighting apparatus having an effective closed structure for waterproofing, dust-proofing, and blocking insects.

An exemplary embodiment of the present invention provides an LED lighting apparatus LED having an economical and simple internal structure to more effectively cope with a change of a light distribution angle.

An LED lighting apparatus according to the present invention includes: a main cover with an elongated pipe shape having a cross-section formed of a closed curve line and both ends of a length direction formed to be open; an external frame sliding-coupled to an external surface of the main cover along a length direction of the main cover; an inner frame having a shape extending in a direction parallel to the length direction of the main cover and sliding-coupled to an internal surface of the main cover along the length direction of the main cover to be positioned at the inner space of the main cover; and a close-and-seal cover closing and sealing both open ends of the main cover to close and seal the inner space of the main cover, wherein the bottom surface of the inner frame supports an emitted LED, and the close-and-seal cover is coupled to the external frame and the inner frame.

A first coupling hole may be formed at both end sides of the external frame in the length direction, a second coupling hole may be formed at both end sides of the inner frame in the length direction, and the close-and-seal cover may be coupled to the external frame and the inner frame by a fastening member coupled to the first coupling hole and the second coupling hole.

A sealing member disposed between the close-and-seal cover and the main cover may be further included.

The cross-section of the main cover may be formed with a shape in which a lower side is curved in a lower direction.

The cross-section of the main cover may be formed with a shape in which the upper side is formed to be flat, but both ends of the upper side may be bent to be connected to the lower side.

An insertion groove that is concave in an inner direction at the upper side of the main cover may be integrally formed with the main cover.

The external frame may include an insertion protrusion corresponding to the insertion groove, and the external frame may be sliding-inserted to the upper side of the main cover to be coupled such that the insertion protrusion is coupled to the insertion groove.

The insertion groove may be symmetrically formed at both sides with reference to the cross-section of the main cover, and the first coupling hole may be formed at the insertion protrusion.

A supporting protrusion that is convex in the inner direction at the internal surface of the lower side of the main cover may be integrally formed with the main cover to support the inner frame.

The supporting protrusion may be symmetrically formed at both sides of the main cover with reference to the cross-section, and both ends of the inner frame may be supported on the supporting protrusion.

The second coupling hole may be respectively positioned at both ends of the inner frame with reference to the cross-section.

The inner frame may include an inclination portion that is inclined in the lower direction at both ends with reference to the cross-section.

A reflection member may be installed at the inclination portion.

The inner frame may be formed with an 'M' shape with reference to the cross-section.

Both ends of the inner frame may be inserted into a space between a top surface of the main cover and the insertion groove with reference to the cross-section to be supported by the internal surface of the main cover.

The inner frame may be formed with a 'V' shape with reference to the cross-section.

The second coupling hole may be positioned at a lower center of the inner frame with reference to the cross-section.

The main cover may be integrally formed while having transparency.

A driving circuit unit driving the LED may be supported at the top surface of the inner frame, and the LED may be included in the bottom surface of the inner frame to support the LED substrate.

A bracket fixing the main cover at an installation place may be further included, and the bracket may be coupled to the external frame.

According to an exemplary embodiment of the present invention, by configuring the close-and-seal cover closing and sealing both ends of the transparent cover to be coupled to the external frame and the inner frame, the effective closed and sealed structure may be realized.

Also, according to an exemplary embodiment of the present invention, by variously configuring the shape of the inner frame coupled to the close-and-seal cover, the various light distribution angles may be efficiency provided while maintaining the closed and sealed structure.

DETAILED DESCRIPTION OF THE EMBODIMENTS

Figure 1:
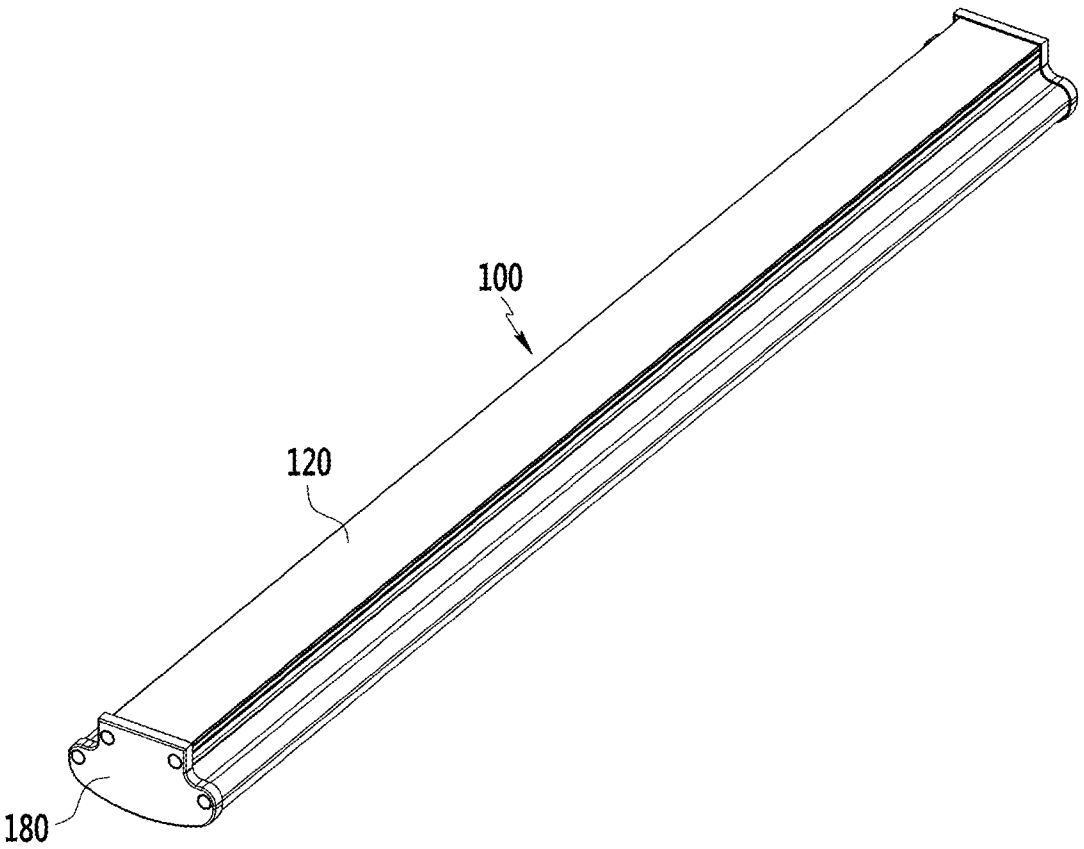
FIG. 1 is a perspective view of an LED lighting apparatus according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

FIG. 1 is a perspective view of an LED lighting apparatus according to an exemplary embodiment of the present invention.

Referring to FIG. 1, the LED lighting apparatus 100 according to an exemplary embodiment of the present invention is formed as a longitudinal type like the fluorescent lamp, and may include a main cover 120 and a close-and-seal cover 180 closing and sealing both ends of a length direction of the main cover 120.

That is, in the LED lighting apparatus 100, by closing and sealing both ends of the length direction as an open portion among the main cover 120 of a tube shape that is integrally formed by the main cover 120, an entirely closed and sealed structure is configured.

Next, a configuration of the LED lighting apparatus 100 to realize the closed and sealed structure will be described in detail.

Figure 2:
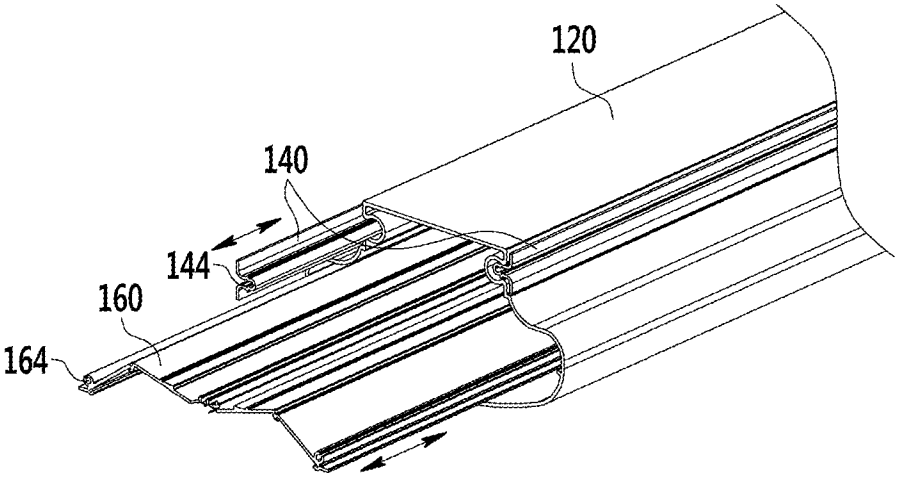
FIG. 2 is a cutaway assembly view of a portion of an LED lighting apparatus according to an exemplary embodiment of the present invention.
Figure 3:
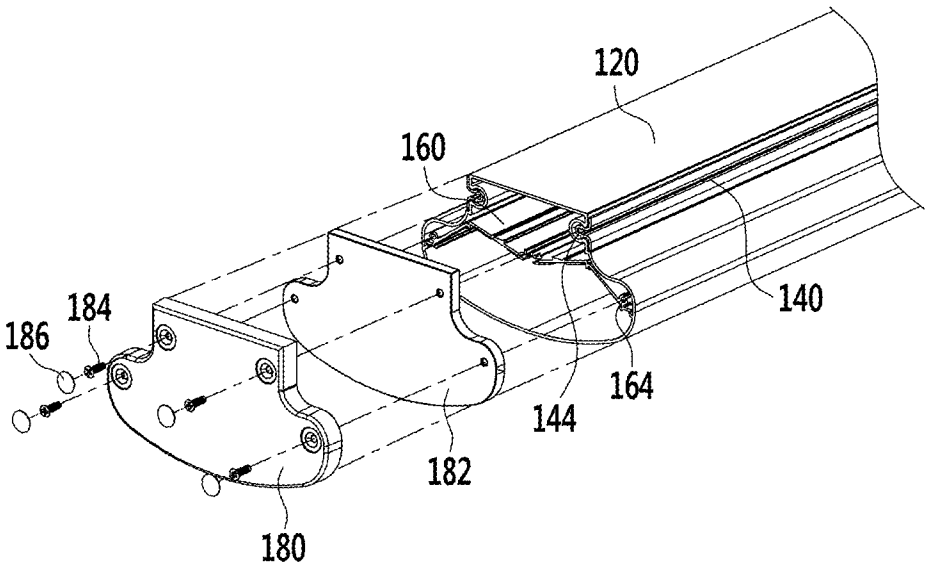
FIG. 3 is an exploded assembly view of another portion of an LED lighting apparatus according to an exemplary embodiment of the present invention.

FIG. 2 is a cutaway assembly view of a portion of an LED lighting apparatus 100 according to an exemplary embodiment of the present invention, and FIG. 3 is an exploded assembly view of another portion of an LED lighting apparatus 100 according to an exemplary embodiment of the present invention.

Figure 4:
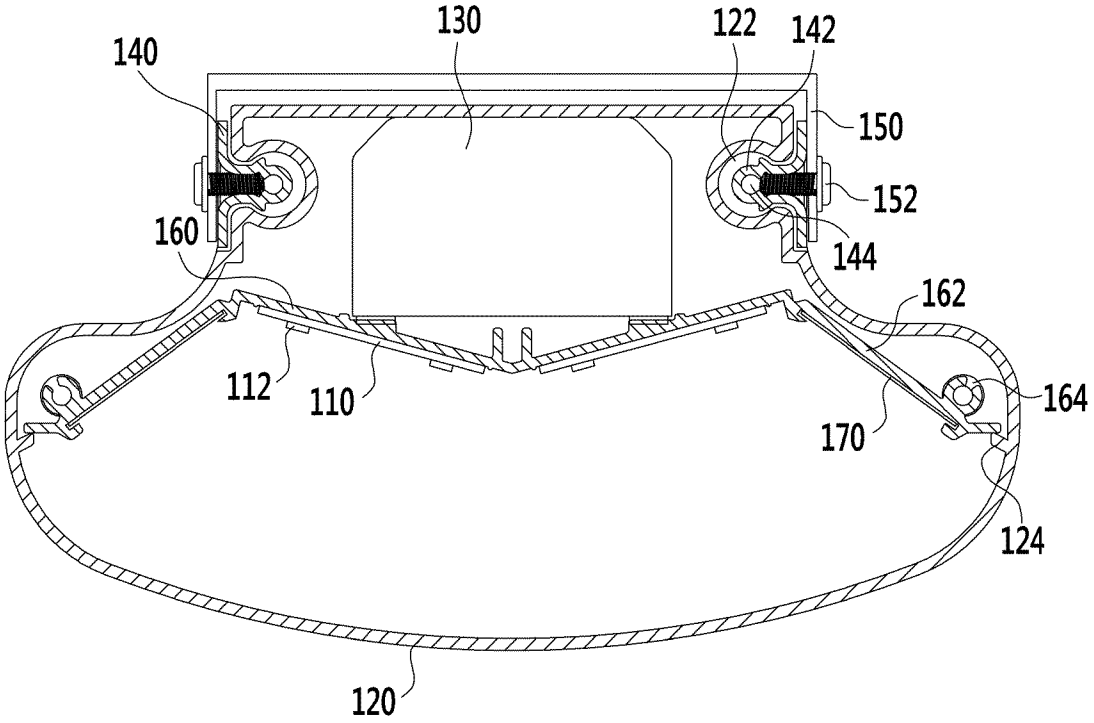
FIG. 4 is a cross-sectional view of an LED lighting apparatus according to an exemplary embodiment of the present invention.

Further, FIG. 4 is a cross-sectional view of an LED lighting apparatus 100 according to an exemplary embodiment of the present invention taken along a direction perpendicular to the length direction of the LED lighting apparatus 100.

Referring to FIG. 2 and FIG. 3, the LED lighting apparatus 100 according to an exemplary embodiment of the present invention includes the main cover 120, an external frame 140, an inner frame 160, and the close-and-seal cover 180.

The main cover 120 configures an outer shape of the LED lighting apparatus 100 and is a portion in which various parts including a light emitting means are installed, and according to an exemplary embodiment of the present invention, as shown in FIG. 2 and FIG. 3, it has a shape of which a cross-sectional area of both ends of the length direction as an elongated pipe shape, referring to FIG. 4, may be formed as a closed curve.

In this case, according to an exemplary embodiment of the present invention, the main cover 120 may be integrally formed.

For example, the main cover 120 may be manufactured through extrusion of a synthetic resin.

Also, the main cover 120 may be formed of a material having transparency.

Accordingly, the main cover 120 may be entirely formed of the closed and sealed structure except at both ends of the length direction, and the light emitted from an LED 112 positioned inside the main cover 120 may be transmitted outside.

In the present specification, if "cross-section" is not otherwise specified as a certain direction, it is defined as a cross-section that is taken along the direction perpendicular to the length direction of the LED lighting apparatus 100.

According to an exemplary embodiment of the present invention, as shown in FIG. 4, the cross-section of the main cover 120 may be formed with a shape such that a bottom portion thereof is downwardly curved.

For example, the lower portion of the main cover 120 may be formed with a shape similar to an oval.

Accordingly, the LED 112 may be efficiency arranged inside the main cover 120, thereby increasing light emission efficiency.

Also, as shown in FIG. 4, for the cross-section of the main cover 120, the upper side may be formed to be flat, and both ends of the upper side may be bent to be connected to the lower side.

For example, the upper portion of the main cover 120 may be formed with a shape similar to a rectangle.

In this case, as shown in FIG. 4, the lower portion of the main cover 120 may have a wider width than the upper portion.

That is, the upper portion of the main cover 120 as a direction in which the light of the LED 112 does not need to be emitted may be minimized in volume and may be formed with a box shape to be easily installed to a ceiling.

In this case, according to an exemplary embodiment of the present invention, as shown in FIG. 4, a bracket 150 may be coupled to the upper portion of the main cover 120, and the LED lighting apparatus 100 may be easily coupled to the installation location such as the ceiling with the bracket 150.

In this case, when the bracket 150 is directly coupled to the main cover 120, since an opening for the coupling may be formed in the main cover 120, to realize the closed and sealed structure of the main cover 120, it is necessary to avoid the bracket 150 from being directly coupled to the main cover 120.

According to an exemplary embodiment of the present invention, the bracket 150 may be coupled to the external frame 140 positioned on the main cover 120, for example, as shown in FIG. 4, the bracket 150 may be coupled to the external frame 140 by a fastening means 152 such as a screw.

In FIG. 1 to FIG. 3, the bracket 150 is omitted for convenience of comprehension.

Next, the external frame 140 will be described in detail.

The external frame 140 is a configuration provided for fixing of the described bracket 150 and coupling of the close-and-seal cover 180 that will be further described later, and according to an exemplary embodiment of the present invention, the external frame 140 may be coupled to the outside of the main cover 120.

In detail, referring to FIG. 2 and FIG. 4, the external frame 140 may be sliding-coupled to the external surface of the main cover 120 along the length direction of the main cover 120.

In this case, according to an exemplary embodiment of the present invention, as shown in FIG. 4, an insertion groove 122 that is concave in an inner direction may be formed at the upper side of the main cover 120, and the insertion groove 122 is integrally formed with the main cover 120 such that the cross-section of the main cover 120 may maintain the closed curve shape.

Further, the external frame 140 may include an insertion protrusion 142 corresponding to the insertion groove 122 of the main cover 120.

Accordingly, the insertion protrusion 142 of the external frame 140 may be coupled to the insertion groove 122 of the main cover 120, and resultantly, the external frame 140 may be sliding-inserted to the upper side of the main cover 120.

In this case, according to an exemplary embodiment of the present invention, as shown in FIG. 4, the insertion groove 122 may be symmetrically formed at both sides with reference to the cross-section of the main cover 120.

Accordingly, the external frame 140 may be configured as a pair and may be symmetrically provided to the external surface of the main cover 120.

Also, a first coupling hole 144 may be formed at the insertion protrusion 142 of the external frame 140 coupled to the insertion groove 122.

As shown in FIG. 3, the first coupling hole 144 as a portion to couple the close-and-seal cover 180 that will be further described later by a fastening member 184, by forming the first coupling hole 144 at the insertion protrusion 142, the first coupling hole 144 may be positioned inside the insertion groove 122, and resultantly the first coupling hole 144 may be disposed close to the inner side of the main cover 120.

Accordingly, the entire outer shape of the apparatus may be maintained, and effective closing and sealing of the apparatus may be realized by the coupling of the close-and-seal cover 180.

Also, by symmetrically configuring the first coupling hole 144 at both sides of the main cover 120, the close-and-seal cover 180 may be stably coupled, and the close and seal function may be effectively realized, and this will be described in detail in a related portion.

On the other hand, the inner frame 160 is provided inside the main cover 120 required with the close and seal function, and hereafter the inner frame 160 will be described.

Referring to FIG. 4, the inner frame 160 is positioned at the inner space of the main cover 120, and is a portion supporting an LED substrate 110 and a driving circuit unit 130.

According to an exemplary embodiment of the present invention, the bottom surface of the inner frame 160 may support the LED substrate 110, and the top surface of the inner frame 160 may support the driving circuit unit 130.

In this case, the LED substrate 110 is mounted with the LED 112 of the light-emitting device, and a plurality of LEDs 112 may be arranged with a constant interval therebetween.

Also, since the driving circuit unit 130 drives the LED 112, the driving circuit unit 130 may include a means for supplying power to the LED substrate 110, various circuit parts, and a substrate.

That is, the LED lighting apparatus 100 according to an exemplary embodiment of the present invention may be configured of a power built-way that the driving circuit unit 130 having a function as a power supply is built inside the main cover 120.

According to an exemplary embodiment of the present invention, as shown in FIG. 2, the inner frame 160 may be formed with a shape extending in a direction parallel to the length direction of the main cover 120.

Also, referring to FIG. 2, the inner frame 160 may be sliding-coupled to the internal surface of the main cover 120 along the length direction of the main cover 120 to be positioned at the inner space of the main cover 120.

In this case, according to an exemplary embodiment of the present invention, as shown in FIG. 4, a supporting protrusion 124 may be formed to protrude in the inner direction at the internal surface of the lower side of the main cover 120 to support the inner frame 160.

In this case, referring to FIG. 4, the supporting protrusion 124 may be formed symmetrically at both sides of the main cover 120 with reference to the cross-section.

Also, the supporting protrusion 124 may be integrally formed with the main cover 120.

Accordingly, both ends of the inner frame 160 may be supported on the supporting protrusions 124 with reference to the cross-section.

On the other hand, according to an exemplary embodiment of the present invention, a second coupling hole 164 may be respectively formed at both sides of the inner frame 160.

As shown in FIG. 3, the second coupling hole 164 is used to couple the close-and-seal cover 180 by the fastening member 184 along with the described first coupling hole 144, and by forming the second coupling hole 164 at both sides of the inner frame 160, with the second coupling holes 164 formed symmetrically at both sides of the main cover 120 such that the close-and-seal cover 180 may be stably coupled, the close and seal function may be effectively realized, and this will be further described in detail in the related portion.

On the other hand, according to an exemplary embodiment of the present invention, as shown in FIG. 4, the cross-section of the inner frame 160 may be formed with an 'M' shape.

Accordingly, an inclination portion 162 that is inclined at a predetermined angle may be formed in the lower direction at both ends of the inner frame 160 with reference to the cross-section.

In this case, referring to FIG. 4, the LED substrate 110 is disposed at the bottom surface of the center of the inner frame 160, and a reflection member 170 may be installed at the bottom surface of the inclination portion 162.

Accordingly, the light emitted by the LED 112 may be reflected by the reflection member 170, and a light distribution angle required by configuring the reflection member 170 with an appropriate position and angle may be formed.

For example, in the case of the exemplary embodiment shown in FIG. 4, a narrow light distribution angle is formed such that the light may reach a further distance, thereby being used for high ceiling lighting installed at a high position.

On the other hand, the LED lighting apparatus 100 of the present invention includes the inner frame 160 with various structures such that the various light distribution angles may be realized, and hereafter another exemplary embodiment of the present invention will be described with reference to drawings.

Figure 5:
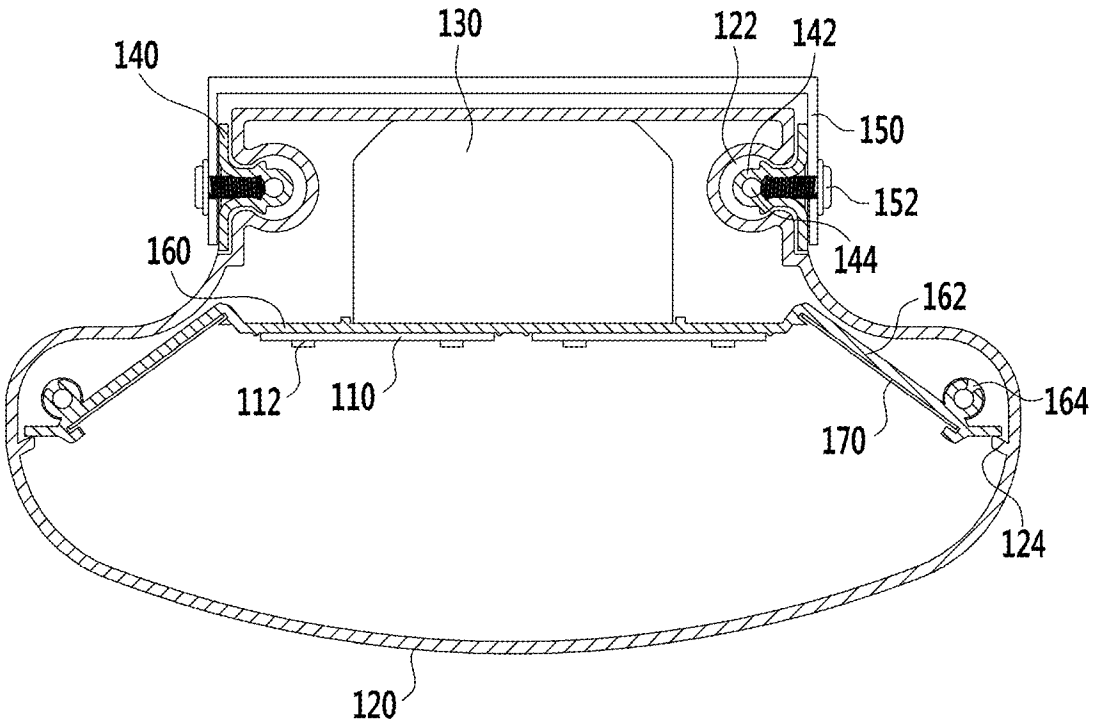
FIG. 5 is a cross-sectional view of an LED lighting apparatus according to a second exemplary embodiment of the present invention.

FIG. 5 is a cross-sectional view of an LED lighting apparatus according to a second exemplary embodiment of the present invention.

Figure 6:
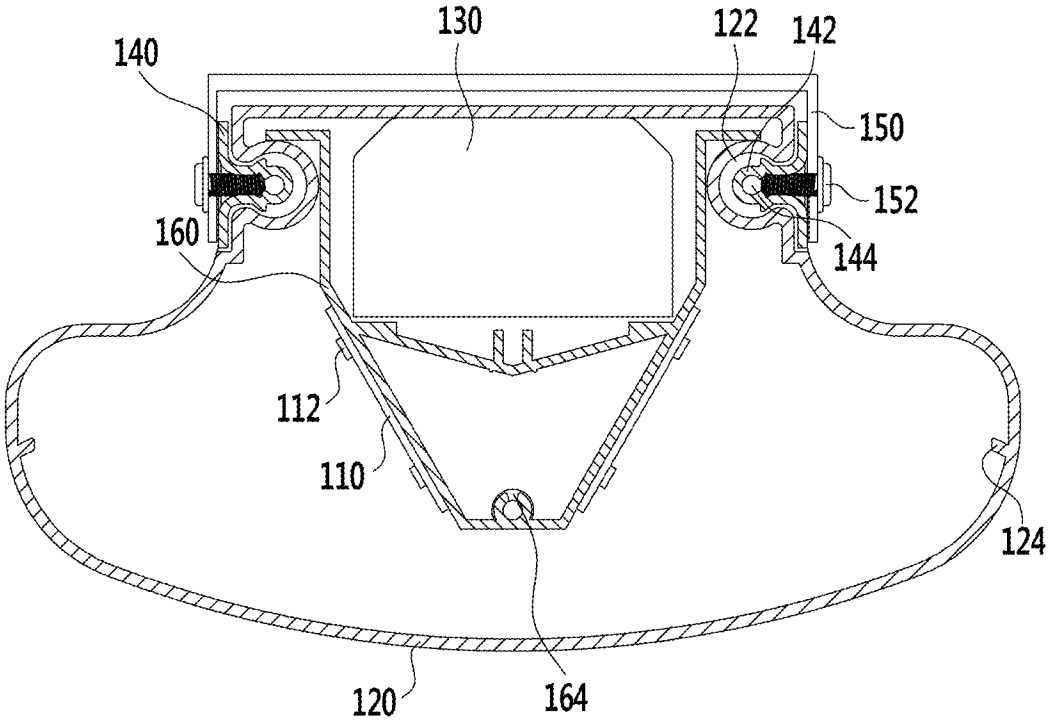
FIG. 6 is a cross-sectional view of an LED lighting apparatus according to a third exemplary embodiment of the present invention.

FIG. 6 is a cross-sectional view of an LED lighting apparatus according to a third exemplary embodiment of the present invention.

Descriptions of the same portions as in the above-described exemplary embodiment (hereinafter, a first exemplary embodiment) for the below description for another exemplary embodiment of the present invention are omitted, and differences from the first exemplary embodiment will be mainly described.

Referring to FIG. 5, according to the second exemplary embodiment of the present invention, the inner frame 160 has a similar shape to that of the first exemplary embodiment with reference to the cross-section, however the center in which the LED 112 is arranged is formed in parallel.

Accordingly, in the case of the second exemplary embodiment of the present invention shown in FIG. 5, the light distribution angle may be wider than in the first exemplary embodiment, and resultantly, it is appropriate for lighting installed at a lower position than the first exemplary embodiment.

All of the structure of the LED lighting apparatus except for the inner frame 160 is the same such only that the inner frame 160 may be replaced while using the structure of one LED lighting apparatus, thereby realizing various light distribution angles.

Resultantly, this may save the manufacturing cost of the LED lighting apparatus, thereby being effective in terms of economy.

On the other hand, according to the third exemplary embodiment of the present invention, the cross-section of the inner frame 160 may be formed with a 'V' shape.

Referring to FIG. 6, based on the cross-section, both ends of the inner frame 160 are inserted to a space between the top surface of the main cover 120 and the insertion groove 122 such that the inner frame 160 may be supported by the internal surface of the main cover 120.

In this case, according to an exemplary embodiment of the present invention, the second coupling hole 164 coupled with the close-and-seal cover 180 may be positioned at a lower center of the inner frame 160.

Accordingly, differently from the first and second exemplary embodiments, only one second coupling hole 164 is provided, but a triangle shape is formed along with a pair of first coupling holes 144 positioned at the upper portion such that the close-and-seal cover 180 may be stably coupled and the close and seal function may be effectively realized.

Also, in the case of the third exemplary embodiment, the separate reflection member reflecting the light emitted from the LED 112 is not provided and the LED 112 is arranged at the inner frame 160 of the 'V' shape, thereby spreading the light emitted from the LED 112 in a further wider range.

Accordingly, the third exemplary embodiment may be appropriate for lighting installed at a place requiring a backlight distribution or a place for ensuring wide light distribution such as the lower ceiling.

Further, in the third exemplary embodiment, the structure of the LED lighting apparatus except for the inner frame 160 is all the same such that only the inner frame 160 may be replaced while using the structure of one LED lighting apparatus, thereby realizing the various light distribution angles and being effective in terms of economy.

That is, the present invention may realize the various light distribution angles by only the variation of the inner frame 160 while maintaining the closed and sealed structure.

Figure 7:
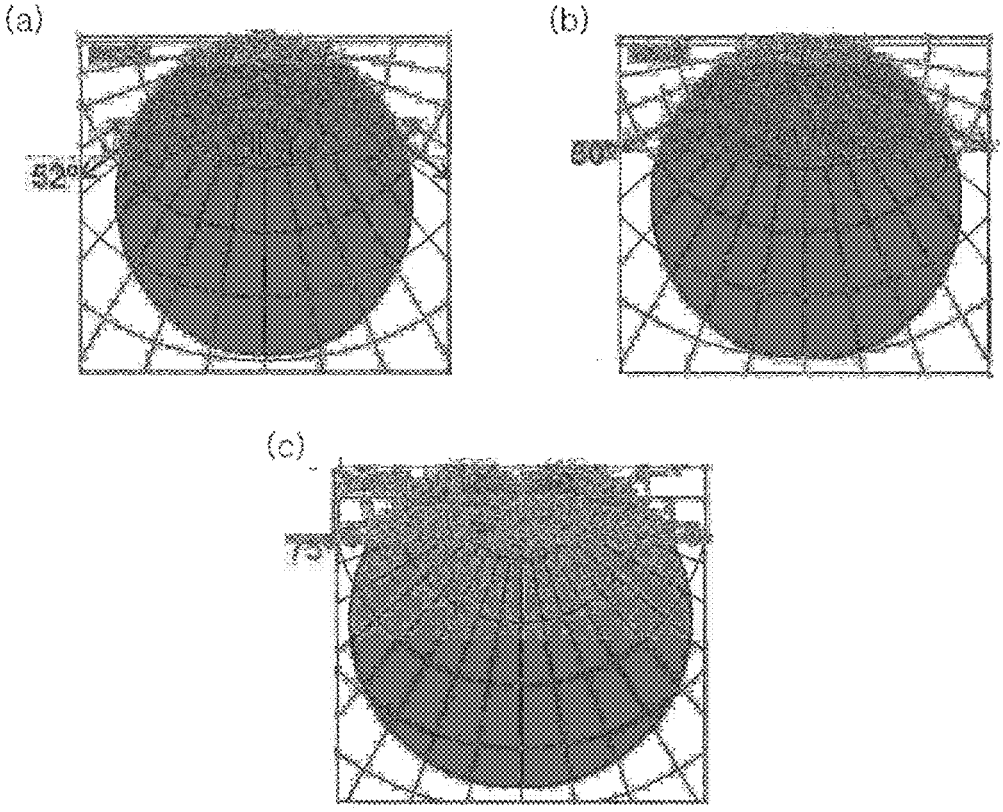
FIG. 7 is a view of a light distribution curve of an LED lighting apparatus according to various exemplary embodiments of the present invention.

FIG. 7 shows a light distribution curve of a light distribution angle of an LED lighting apparatus according to various exemplary embodiments of the present invention.

FIG. 7 shows the light distribution curve of the light distribution angle of the first to third exemplary embodiments through an experiment, wherein (a) shows the light distribution angle of the first exemplary embodiment, (b) shows the light distribution angle of the second exemplary embodiment, and (c) shows the light distribution angle of the third exemplary embodiment.

Next, the close-and-seal cover 180 and the combination structure thereof for realizing the effective closing and sealing of the LED lighting apparatus 100 according to an exemplary embodiment of the present invention will be described.

Referring to FIG. 1 and FIG. 3, the close-and-seal cover 180 is a configuration for closing and sealing both open ends of the length direction of the main cover 120 to close and seal the inner space of the main cover 120.

In this case, referring to FIG. 3, for the effective closing and sealing, a sealing member 182 may be installed between the close-and-seal cover 180 and the main cover 120.

The sealing member 182 may be made of a material having flexibility, and may be made of a material having waterproofing, dust-proofing, and insect blocking properties.

On the other hand, according to an exemplary embodiment of the present invention, the close-and-seal cover 180 may not be directly coupled to the main cover 120, but may be coupled to the external frame 140 and the inner frame 160.

For example, referring to FIG. 2 and FIG. 3, a first coupling hole 144 may be formed at both end sides of the length direction of the external frame 140 and a second coupling hole 164 may be formed at both end sides of the length direction of the inner frame 160.

In this case, as shown in FIG. 3, the close-and-seal cover 180 may be coupled to the first coupling hole 144 and the second coupling hole 164 by the fastening member 184.

For example, the fastening member 184 may be a screw, the first coupling hole 144 and the second coupling hole 164 may be screw holes corresponding to the screw, and as shown in FIG. 3, a protection cover 186 may be installed to the portion coupled with the screw outside the close-and-seal cover 180.

Accordingly, the opening for fastening the close-and-seal cover 180 may not be formed at the main cover 120 such that the interior of the main cover 120 may be formed of the closed and sealed structure.

On the other hand, through the coupling between the described fastening member 184, and the first coupling hole 144 and second coupling hole 164, the function of stably fixing the external frame 140 and the inner frame 160 may be performed.

In detail, the external frame 140 is coupled to the external surface of the main cover 120, and for realizing the closed and sealed structure of the main cover 120, the insertion coupling is performed between the insertion groove 122 and the insertion protrusion 142 without an additional fixing means or fastening means.

Accordingly, the coupling between the main cover 120 and the external frame 140 may be weak such that the external frame 140 may be separated from the main cover 120 by an external impact.

However, the close-and-seal cover 180 is coupled to the external frame 140 through the fastening member 184 at both ends of the main cover 120 in the length direction, such that the external frame 140 may stably fix the main cover 120.

Also, the inner frame 160 is coupled to the internal surface of the main cover 120, and to realize the closed and sealed structure of the main cover 120, the inner frame 160 is simply supported on the protrusion structure by the supporting protrusion 124 or the insertion groove 122 without the additional fixing means or the fastening means.

Accordingly, the inner frame 160 may sag in the lower direction by the weight of the driving circuit unit 130 supported by the inner frame 160 such that the shape of the inner frame 160 may be deformed.

However, the close-and-seal cover 180 is coupled to the inner frame 160 through the fastening member 184 at both ends of the main cover 120 in the length direction such that the inner frame 160 may be stably fixed inside the main cover 120 and the inner frame 160 or the shape thereof may be prevented from sagging or twisting in the lower direction.

As described above, in the LED lighting apparatus 100 according to an exemplary embodiment of the present invention, the close-and-seal cover 180 closing and sealing both ends of the main cover 120 in the length direction are coupled to the external frame 140 and the inner frame 160, not the main cover 120, thereby effectively realizing the closed and sealed structure.

Further, while using the structure of the lighting apparatus as it is, by only variously changing the shape of the inner frame 160 arranged with the LED 112, the various light distribution angles may be effectively realized while maintaining the closed and sealed structure.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

<Description of Symbols>

| | | | |
|---|---|---|---|
| 100 | LED lighting apparatus | 110 | LED substrate |
| 112 | LED | 120 | main cover |
| 122 | insertion groove | 124 | supporting protrusion |
| 130 | driving circuit unit | 140 | external frame |
| 142 | insertion protrusion | 144 | first coupling hole |
| 150 | bracket | 152 | fastening means |
| 160 | inner frame | 162 | inclination portion |
| 164 | second coupling hole | 170 | reflection member |
| 180 | close-and-seal cover | 182 | sealing member |
| 184 | fastening member | 186 | protection cover |

What is claimed is:

1. An LED lighting apparatus comprising:

a main cover with an elongated pipe shape having a cross-section formed of a closed curve line and both ends of a length direction formed to be open, the main cover accommodating an LED and a driving circuit unit driving the LED;

an external frame sliding-coupled to an external surface of the main cover along a length direction of the main cover;

an inner frame having a shape extending in a direction parallel to the length direction of the main cover and sliding-coupled to an internal surface of the main cover along the length direction of the main cover to be positioned at the inner space of the main cover; and a close-and-seal cover closing and sealing both open ends of the main cover to close and seal the inner space of the main cover, wherein a bottom surface of the inner frame supports an LED substrate including the LED, and top surface of the inner frame supports the driving circuit unit, the close-and-seal cover is coupled to the external frame and the inner frame, an insertion groove that is concave in an inner direction at an upper side of the main cover is integrally formed with the main cover, the external frame includes an insertion protrusion corresponding to the insertion groove, the external frame is sliding-inserted to the upper side of the main cover to be coupled such that the insertion protrusion is coupled to the insertion groove, a first coupling hole is formed at both end sides of the external frame in the length direction, a second coupling hole is formed at both end sides of the inner frame in the length direction, and the close-and-seal cover is coupled to the external frame and the inner frame by a fastening member coupled to the first coupling hole and the second coupling hole.

2. The LED lighting apparatus of claim 1, wherein a supporting protrusion that is convex in the inner direction at the internal surface of the lower side of the main cover is integrally formed with the main cover to support the inner frame.

3. The LED lighting apparatus of claim 2, wherein:

the supporting protrusion is symmetrically formed at both sides of the main cover with reference to the cross-section; and both ends of the inner frame are supported on the supporting protrusion.

4. The LED lighting apparatus of claim 3, wherein the inner frame includes an inclination portion that is inclined in the lower direction at both ends with reference to the cross-section.

5. The LED lighting apparatus of claim 4, wherein a reflection member is installed at the inclination portion.

6. The LED lighting apparatus of claim 4, wherein the inner frame is formed with an 'M' shape with reference to the cross-section.

7. The LED lighting apparatus of claim 3, wherein the second coupling hole is respectively positioned at both ends of the inner frame with reference to the cross-section.

8. The LED lighting apparatus of claim 1, wherein:

the insertion groove is symmetrically formed at both sides with reference to the cross-section of the main cover; and the first coupling hole is formed at the insertion protrusion.

9. The LED lighting apparatus of claim 8, wherein both ends of the inner frame are inserted into a space between a top surface of the main cover and the insertion groove with reference to the cross-section to be supported by the internal surface of the main cover.

10. The LED lighting apparatus of claim 9, wherein the inner frame is formed with a 'V' shape with reference to the cross-section.

11. The LED lighting apparatus of claim 10, wherein the second coupling hole is positioned at a lower center of the inner frame with reference to the cross-section.

12. The LED lighting apparatus of claim 1, wherein the cross-section of the main cover is formed with a shape in which a lower side is curved in a lower direction.

13. The LED lighting apparatus of claim 12, wherein the cross-section of the main cover is formed with a shape in which the upper side is formed to be flat, but both ends of the upper side are bent to be connected to the lower side.

14. The LED lighting apparatus of claim 1, further comprising a sealing member disposed between the close-and-seal cover and the main cover.

15. The LED lighting apparatus of claim 1, wherein the main cover is integrally formed while having transparency.

16. The LED lighting apparatus of claim 1, further comprising a bracket fixing the main cover at an installation place, and the bracket is coupled to the external frame.

* * * * *